United States Patent [19]

Steinke et al.

[11] Patent Number: 4,618,987

[45] Date of Patent: Oct. 21, 1986

[54] LARGE-AREA ACOUSTIC RADIATION SYSTEM

[75] Inventors: Gerhard Steinke; Peter Fels; Wolfgang Hoeg; Werner Lorenz; Wolfgang Ahnert, all of Berlin; Frank Steffen, Blankenfelde; Walter Reichardt, Dresden, all of German Democratic Rep.

[73] Assignee: Deutsche Post, Rundfunk-und Fernsehtechnisches Zentralamt, Berlin-Adlershof, German Democratic Rep.

[21] Appl. No.: 647,951

[22] Filed: Sep. 6, 1984

[30] Foreign Application Priority Data

Dec. 14, 1983 [DD] German Democratic Rep. ... 257890

[51] Int. Cl.[4] ..... H04R 1/22

[52] U.S. Cl. ..... 381/82; 381/90

[58] Field of Search ..... 381/82, 83, 85, 90, 381/91, 107, 63; 181/30

[56] References Cited

U.S. PATENT DOCUMENTS

| | | | |
|---|---|---|---|
| 3,681,531 | 8/1972 | Burkhard | 381/63 |
| 4,039,753 | 8/1977 | Balogh | 381/83 |
| 4,061,876 | 12/1977 | Jaffe | 381/63 |
| 4,268,717 | 5/1981 | Moore | 381/63 |
| 4,472,834 | 9/1984 | Yamamuro | 381/63 |
| 4,481,660 | 11/1984 | de Koning | 381/85 |
| 4,536,887 | 8/1985 | Kaneda | 381/94 |

FOREIGN PATENT DOCUMENTS

| | | | |
|---|---|---|---|
| 138266 | 3/1976 | German Democratic Rep. | 381/63 |
| 56-61893 | 5/1981 | Japan | 381/82 |

OTHER PUBLICATIONS

G. Steinke, "Delta Stereophony . . . " *Journal of Audio Engineering Society,* vol. 31, No. 7, Jul. 1983.

*Primary Examiner*—Gene Z. Rubinson
*Assistant Examiner*—L. C. Schroeder
*Attorney, Agent, or Firm*—Jordan and Hamburg

[57] ABSTRACT

The invention relates to acoustically radiating randomly large rooms and surfaces according to propagation time principles, whereby action or representation and reception or listening areas border directly on one another or are identical. Its object is to avoid error locations and skipping effects caused by movements, which are especially interfering for important solo sound sources. The resulting object of realizing a propagation time staggering without limiting source areas, and responding to the acoustic capacity of the sources, is solved by means of a control device connected to the delay or amplification devices, and which differentiatedly controls them analogous to the sound paths between the source and the acoustic radiator locations.

12 Claims, 6 Drawing Figures

LARGE-AREA ACOUSTIC RADIATION SYSTEM

Figure 1:
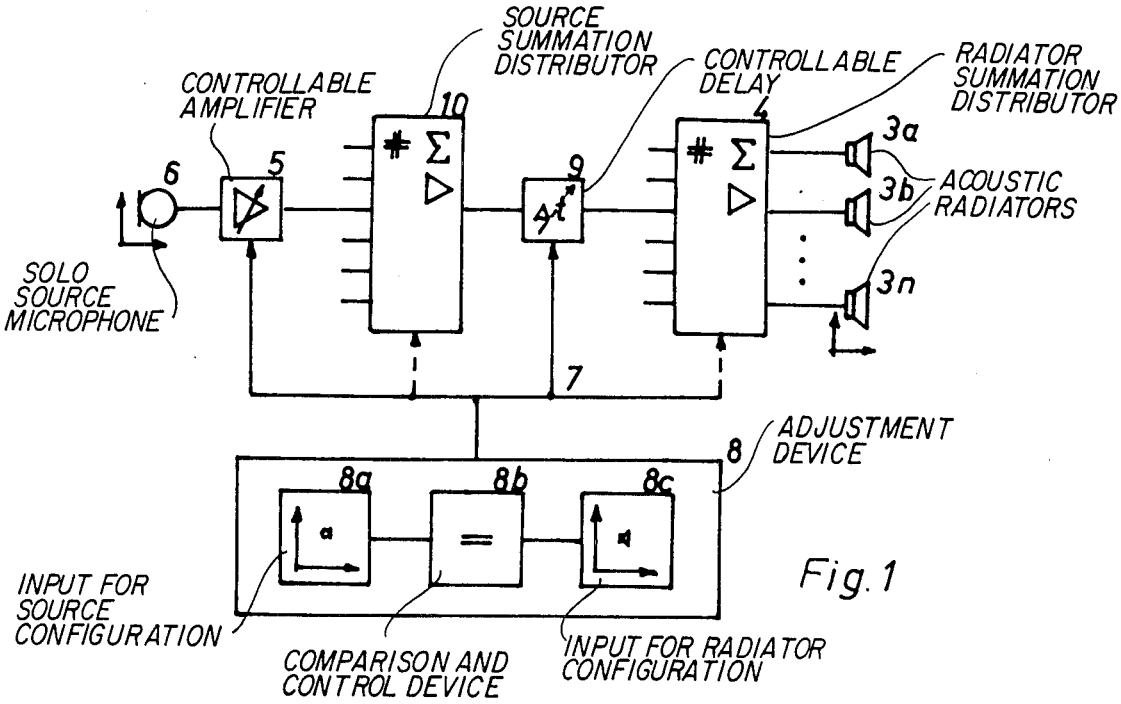

The invention relates to a large-area acoustic radiation system, suitable in particular for the application of acoustically radiating rooms of any size or open spaces, which hereafter will be referred to collectively as reception areas, within which, from an equally extended action area, which can be understood to mean a stage, an arena, circus rings, or the like, performances take place and should also be arranged, whereby it is also possible that the two areas overlap.

Characteristics of the known technical solutions

The known large-area acoustic radiation systems can almost all be grouped under three basic principles:

The first, and the most commonly used, is the principle of central acoustic radiation. One or more acoustic radiators of suitable directional effect are positioned mainly centrally in, over, or on the periphery of the action area. From each position of the reception area, the presentations are invariably located on the nearest acoustic radiator location. This principle is unsuitable for very large action and/or reception areas. The error locations become more and more noticeable in large action areas, and the danger of acoustic regenerative feedback increases. In very large reception areas, even with good directional features of the radiators, the differences in sound level distribution and acoustic coloration distribution can no longer be balanced. It can also result in propagation time fluctuations.

The second principle relates to a decentralized sound radiation by means of acoustic radiators which are distributively arranged in the reception area. Various solutions have been proposed for the layout of the acoustic radiators. The variations range from a few additional radiators in the disadvantaged zones of the reception area for acoustic radiation systems according to the first principle, to the allotment of one individual sound radiator to each listening location, to the utilization of an additional equalization of the propagation time for the acoustic radiators positioned in the depth of the reception area.

The danger of regenerative feedback can be reduced in this way. The disadvantages inherent in this principle relate mainly to the missing or erroneous localization of the sound source in large parts of the reception area.

The third principle utilizes the possibilities of a two or multiple-channeled intensity or phase stereophony, in connection with a localization according to the physical characteristics of either the phantoming of the sound sources, or of the first wave front. In addition to applications in radio stereophony, this principle is applied, among others, mainly for soundfilm reproductions, where because of optical reasons, there already exists a distance between the reception area and the action area, which in this case is vertically surface-like, and whereby the reception area has a low width expansion. By increasing expansion, not only of the reception area, but also of the action area, the technical sophistication increases considerably, and localization errors or positional flat-tunings increase. The reception area, in which a correct localizing according to amplitude ratios or phase allocations is possible, in general is considerably smaller than the distance between the acoustic radiators. For large-area acoustic sound radiation, whereby existing rooms have to be maximally utilized as action and reception areas, intensity or phase stereophony is therefore insufficient.

On the basis of these basic principles, a large-area acoustic radiation system has become known (GDR-P No. 120 341), which, up to now, in its various realizations has produced the best results in localization, sound quality, and spatial perception. It consists of a division of the action area into several spatially limited source areas, whereby each one thereof is assigned microphones and delay elements. The electrically delayed signal portions of the source areas which are delayed individually by slightly more than the natural sound propagation time in reference to the sound radiator location (with respect to an individual point of reference in this source area) are added together in non-reactive summation circuits, which are assigned to the acoustic radiators. The changes of the location of the mobile sound sources and of the changeable configuration of the action area are carried out by conventional transfer or fade-in mechanisms, which are located between the microphones and the delay elements, and which thereby transfer the location either more or less to one or another source area via the signal amplitudes change of the delay devices. Additional delay elements and spatially distributed acoustic radiators connected to them are provided for increasing the spaciality and definition, whereby their signals of timing and amplitude continuously follow the signals of the primary acoustic radiators.

The disadvantage of this system consists in the deteriorating sound localization, which always results when usually relatively low-capacity original sound sources, such as, for instance, speakers, singers, or instruments, which hereafter will be referred to summarily as solo sources, perform either alone or in small groups. Such solo sources occur relatively frequently, and their presentations usually are of special significance. It is therefore unfavorable, that especially with such solo sources, which frequently are also mobile, the locating takes place only very diffusely, erroneously or irregularly alternatingly.

OBJECT OF THE INVENTION

The object of the invention is to reduce the above-mentioned disadvantages of the latter-described system, without thereby significantly increasing the cost, or in any way decreasing the obtained advantages.

EXPLANATION OF THE NATURE OF THE INVENTION

Analyses of the technical causes of the deficiencies, and examinations of system variations have shown that the deficiencies of the above-described system cannot be eliminated by maintaining all of the main characteristics, because the system is designed for discrete, spatially limited source areas, and therefore is provided with a rastering in the action area, and furthermore, it does not take into consideration the acoustic capacity of the sources.

The object of the invention, therefore, is to provide a large-area acoustic radiation system which is designed for the total, even overlapping, action area and which, at least for solo sources, avoids the rastering in spacially limited source areas; which is responsive to the acoustic capacity of the sources, and which thereby accomplishes the necessary propagation time staggering.

According to the invention, the object is solved, by distributing the acoustic radiators in the reception and the action areas, and the devices assigned to them for differentiated, non-reactive summation and distribution are connected to controllable delay or amplification devices, which are connected at least to the microphones assigned to solo sources. The control inputs of the controllable delay or amplification devices are connected to adjustment or control devices for differentiated approximately sound-path proportional control analogous to the sound paths between the individual source location and the acoustic radiator locations.

According to the invention, the principal function of the large-area acoustic radiation system is based on an approximated timing, and if necessary, volume fidelity support or simulation of the sound fields having a timing source priority, expanding from the source over the action area into the reception area, i.e., the acoustic radiators radiate each time only after the passing of the wave fronts of the original sound source, or after the acoustic radiator which simulates it, and the acoustic radiators which are closer to the source, and the time lags or amplifications are differentiated according to the capacity and the class of the sources.

While the comparison system represents the stage before the localization according to amplitude or phase for a pure propagation localization in a source area raster, in reference, however, to the listener and the angle of the room, the invention eliminates the contradictions between the propagation and the amplitude localization even in the areas of transition where, in comparison, usually the first audible acoustic radiator used to be located instead of the original sound source, and refers to the source, the action area and the acoustic radiator location, and is responsive to the capacity of the sound source.

In this respect, it is also advantageous that in addition to the stationary acoustic radiators in the action and reception areas, preferably in the proximity of the solo sources, acoustic radiators of variable location are utilized. To the inputs of the series-connected devices for differentiated, non-reactive summation and distribution are connected outputs of controllable delay or amplification devices, which are assigned to stationary and locationally variable solo sources, whereby at least by stationary solo sources their control inputs, in addition, are triggered by the coordinates of the location change of the locationally variable acoustic radiator.

The control device preferably consists of a comparison and control device and an input apparatus for source or microphone positions which are connected to the comparison inputs of the comparison and control device, whereby the control outputs of the comparison and control device are connected to the control inputs of the controllable delay or amplification devices. Further connections of the control outputs to the devices for differentiated, non-reactive summation and distribution can also be advanageous in various applications.

Although the higher location definition of the system according to the invention is generally advantageous for solo sources in comparison to the comparable system, it can, however, also be disadvantageous for a closed acoustic impression of greater sound bodies and for the spatial perception. In an advantageous further development of the invention, it is also possible to connect the two systems, so that the inputs of the devices for differentiated, non-reactive summation and distribution are connected not only to controllable, but also to fixedly adjusted devices for the delay in front of which, additionally, are inserted devices for differentiated, non-reactive presummation and distribution assigned to the sources having on their inputs stationary microphones. The propagation time or level classification of the solo sources thereby takes place between the propagation time or level of the original sound, or of a replacement sound source simulating the original sound and the summation signal formed by the equilocational, spatially extended source. Depending on the inherent capacity of the sources, the level classification can take place either alternatingly or combined with the propagation time classification.

The utilization of the invention is of special importance for the transitional area between the action and the reception areas, i.e. not only for the acoustic radiators and microphones positioned therein, but also for the sources which have to be located there and for the listeners who are placed there. The conditions become less critical by increasing depth extension of the action and reception areas. For an especially economical embodiment, in addition to the presummation of distant sources, it is therefore advantageous to connect the controllable delay or amplification devices and the adjustment or control devices mainly to the acoustic radiators and microphones positioned in the transitional area between the action and the reception areas, whereby acoustic radiators positioned further away in the reception area receive fixed or approximately staggered level or timing allocations for their corresponding assigned devices for differentitated, non-reactive summation.

Such acoustic radiators positioned further away in the reception area have already been considered in the comparable system for increasing the spaciality and transparency, whereby additional delay elements for a continuous timewise and amplitudewise connection to the signals of the primary loudspeaker groups provided there are assigned to them.

In order to integrate the reproduction of solo sources, especially of mobile sound sources, in a desired acoustic field which has to be complexly simulated, for obtaining audio events of various clarity, intelligibility or spacial impressions, the delays for acoustic radiators positioned at a greater distance remain fixedly assigend to the acoustic radiator location differences. In a further development of the invention, however, in addition to the delay or amplification devices of the sources, also the devices for producing the reflection are controllable depending on the source location, and are connected to the control device. In accordance with the selected degree of simulation of the acoustic sound fields, the energy portions of the various signals, which are supplied to the acoustic radiators positioned at a greater distance, are controlled so that the clarity value $C_{80} \geqq 0$ db, the intelligibility value $C_{50} \geqq 0$ db, or the spatial impression value $R \geqq 0$ db, by respecting the condition, that the Hall signals arrive last at the listening location, can be adjusted.

A further improvement of the localization can be achieved mainly when not only solo sources, but also large sound bodies have to be taken into consideration, by positioning in the action area or in the transitional area between the action and the reception areas subsidiary acoustic radiators approximately at the height of the sources, whereby the devices which are inserted before them for differentiated summation and distribution comprise subsidiary acoustic dampeners or subsidiary delays in such inputs before which additional devices for non-reactive summation are inserted.

The adjustment or control device for differentiated, approximately sound-path proportional control analogous to the sound paths consists in the simplest case of a simulated action surface comprising an operating field representing the microphone location for setting the delay or the amplification.

In a further development of the invention, mainly for mobile solo sources, it is more advantageous, if the approximately sound-path proportional control is executed automatically directly from the change of the microphone location in the action area, whereby the adjustment or control device for differentiated, approximately sound-path proportional control is connected to a source locating device for the microphone location in the action area, which preferably consists of distance measurements with the comparison of the propagation times of measuring signals transmitted electrically or optically and supplied acoustically via the sound path between the acoustic measuring signal generator and the microphone. Either the acoustic measuring signal generator or, more advantageously, the microphone, can thereby be assigned to the source location.

Between the simulated action surface of the distance measuring equipment and the adjustment or control device an arithmetic unit for translating the variable initial parameters of the simulated action surface or the source locating equipment in control values for the controllable delay or amplification devices taking into consideration the stored acoustic, spatial or system-technical parameters of the acoustic radiation system is advantageously connected into the circuit. A simple proportional and even change of the delay, as well as also a simultaneous or alternating change of amplification cannot be performed without this arithmetic unit except in the simplest applications because of the usually complicated, on the one hand, spatial, and on the other hand, acoustic conditions. Especially the localization at simultaneous level and timing differences, depending on the acoustic radiator and source distances, follows rather complex functions which, although known, cannot be realized in analog circuit engineering without the representative design effort. By means of these arithmetic units, it is also possible to provide a desired timing coordination, whereby the signal portions of the solo sources at the acoustic radiator locations are timewise incorporated between the passing original sound and the signal portion of greater sound bodies, and thereby decrease level differences which lead to covering or falsifying the propagation time localization.

The large-area acoustic radiation system with its adjustment or control devices also meets the requirements for better avoiding acoustic regenerative feedback. The danger of spurious acoustic feedback can be reduced even under more complicated conditions in a further development of the invention, whereby the output lines of delay devices for diffentiated, non-reactive summation and distribution of subsidiary acoustic radiators assigned to solo sources are connected to controlable dampening elements, which are connected via a location coincidence test device, which preferably is connected to the arithmetic unit, or is a component thereof, as well as to the simulated action surface or the source location devices, not only for the microphones, but also for the locationally variable acoustic radiators, and the location coincidence is compared to and evaluated against a storage value.

In addition to the above mentioned fundamental improvement or variation possibilities of the acoustic radiation system, with respect to a qualitatively outstanding and economical realization, further improvements have been made possible with the main points of the invention.

An especially low-cost and high-quality configuration of the control of the controllable delay or amplification device for the multitude of channels consists in applying the input sound signal produced by a mobile solo source, or a replacement source simulating it, to the inputs of at least two controllable amplifiers of which the outputs are applied directly, or via a controllable device for the distribution to the inputs of summators, and that additionally to the input configuration of the source or microphone positions of the control device, there is also provided an operating module for modulating the level, and that both output control signals are connected via multiplying control circuits, which are applied to the control input lines of the controllable amplifiers.

The above mentioned input configuration of the source positions or microphone positions advantageously consists of a configuration of controls, whereby the primary connections thereof are applied to a common potential, and each of the secondary connections thereof leads to an input of an OR-circuit, of which the output is connected to the first input of an AND-circuit, whereby on its second input is applied a timing signal of variable frequency. The output of the AND-circuit is connected to the timing inputs of the up/down counters, of which each of the F/R control inputs is connected to the secondary connections of the controls. Each of the data outputs of the counters is connected to the input of an assigned coder of which the output is connected to the control inputs of the controllable delay or amplification devices or to the allocation devices.

An advantageous configuration of a source locating device for the automatic control of the adjustment or control device by measuring the distance in comparison to electric or optical and acoustic propagation times, consists in connecting scanned ultrasonic signal generators to ultrasonic radiators. Microphones provided in the action area for solo sources, are connected to ultrasonic receivers or are augmented in the recording frequency range. At the end of the electric or optical transmission distance are provided on the microphone separation devices, preferably PLL-filters, and the keying signals for the ultrasonic radiators and the transmitted recovered keying pulse are applied to a time comparison circuit, which gives off pulses of approximately sound-path proportional duration, and of which the output is connected via a time value converter either directly, or via the computer, to the control inputs of the controllable delay or amplification devices.

With respect to cost, at a small number of acoustic radiators, it is especially advantageous that the acoustic radiator locations are also utilized as acoustic measuring signal generator locations, i.e., to connect the ultrasonic radiators to the acoustic radiators. The time value converter contains a timing pulse generator, which is also linked via separators to the keying pulse generation. Between the time value converter and the adjustment or control device, it is advantageous to provide a memory and comparison device at the output of which each time only the regulation stages and regulation directions of the change are applied, and corresponding stages of the delay or amplification devices are advanced.

At a multitude of acoustic radiator locations, i.e., at a less compact configuration of loudspeakers, the preferred solution consists in providing only a number of acoustic measurement signal generators which unambiguously determines the coordinates of the action area, and to connect the time value converters, via which, in this case, also the arithmetic unit converting the coordinates is connected to the control inputs of the delay or amplification devices.

EXEMPLIFIED EMBODIMENT

Figure 2:
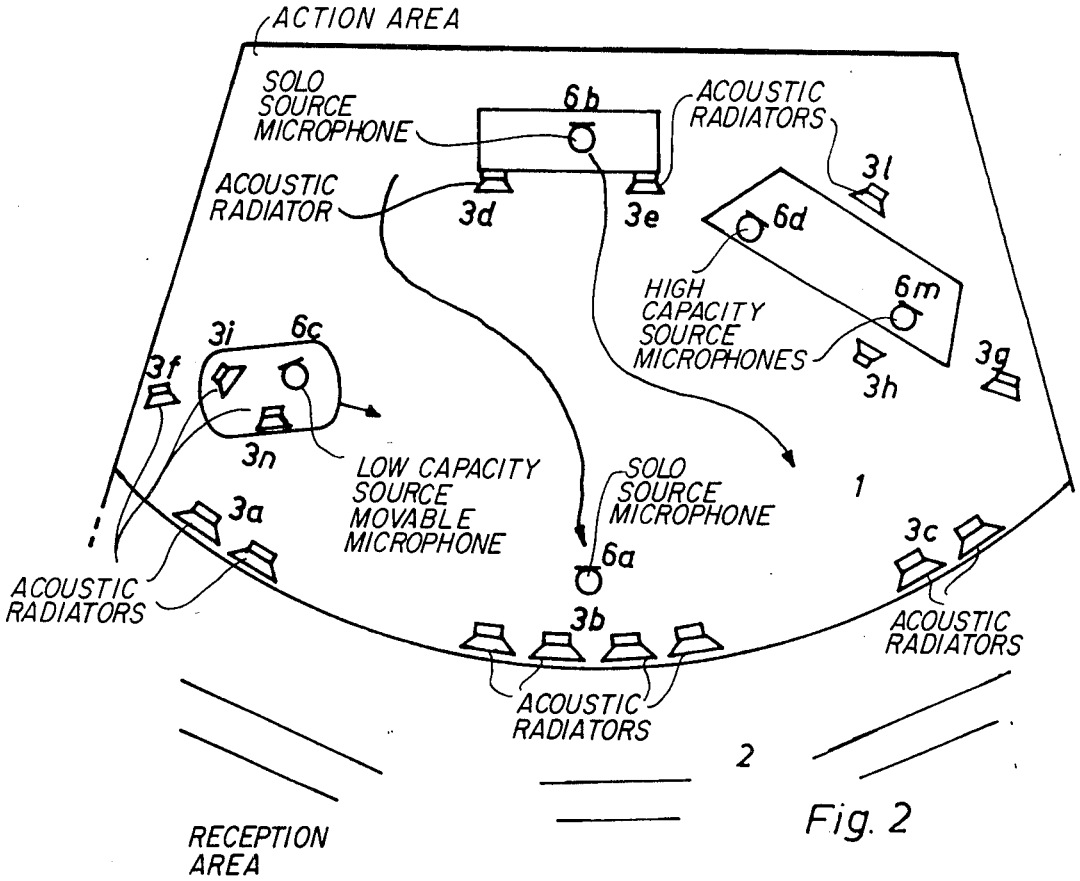
Figure 3:
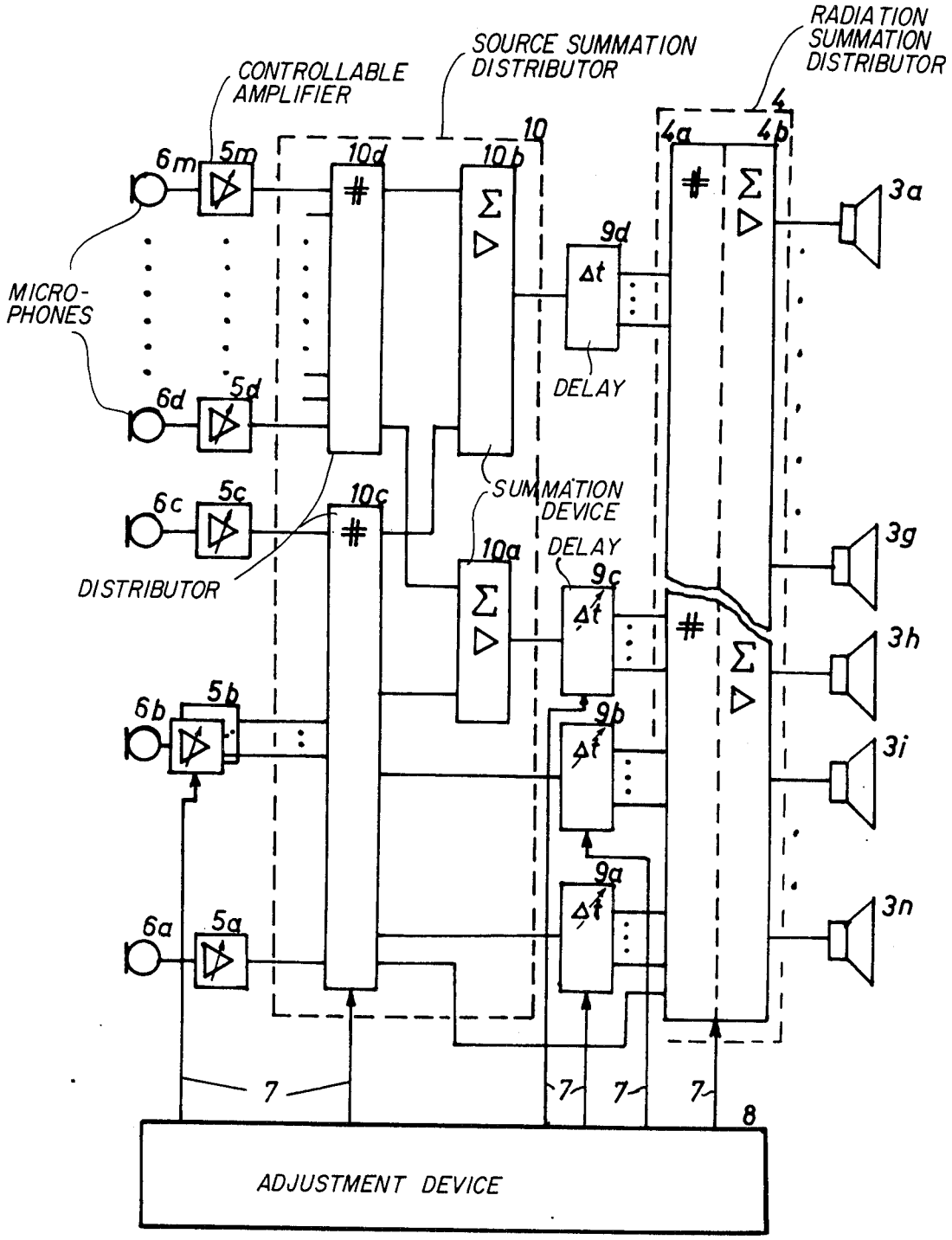
Figure 4:
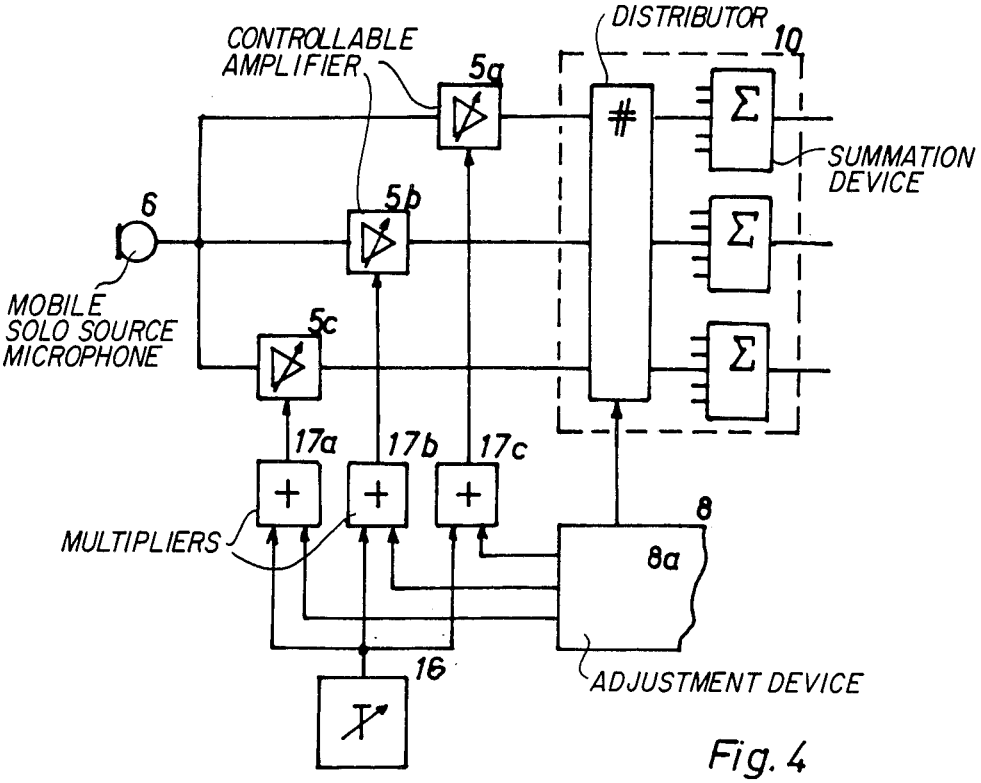
Figure 5:
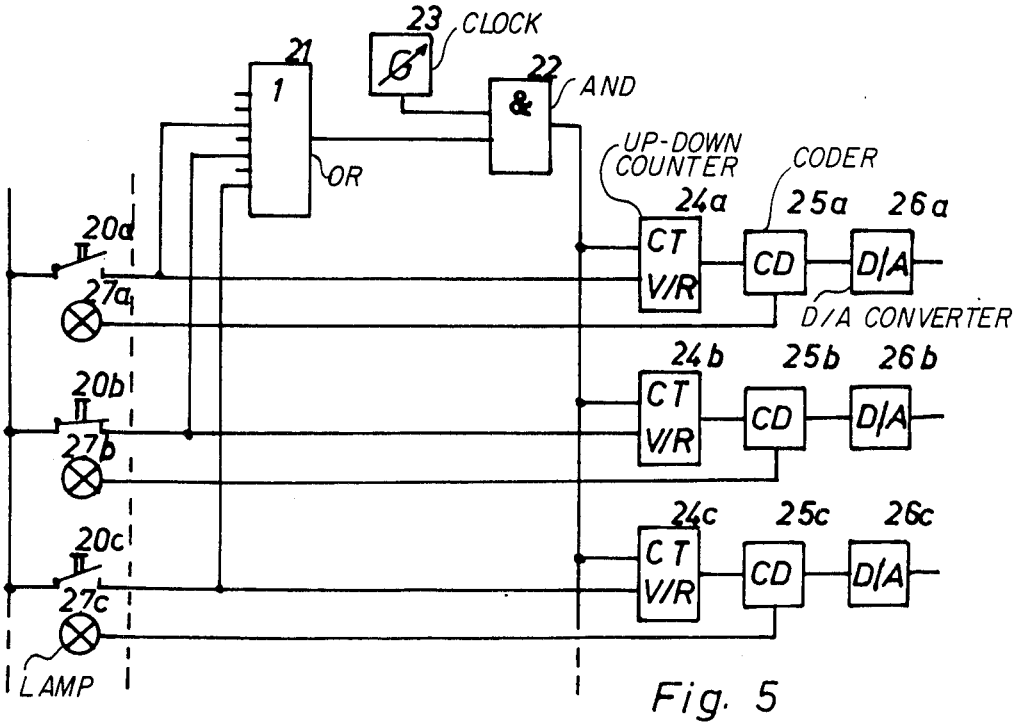

The invention is further explained by means of the following exemplified embodiments. The accompanying drawings show the following in schematic presentation:

FIG. 1: a fundamental block circuit diagram;

FIG. 2: a spatial configuration of microphones and acoustic radiator configurations;

FIG. 3: a block circuit diagram of a possible configuration of FIG. 2;

FIG. 4: a preferred controllable amplification device;

FIG. 5: a manual input configuration, and

Figure 6:
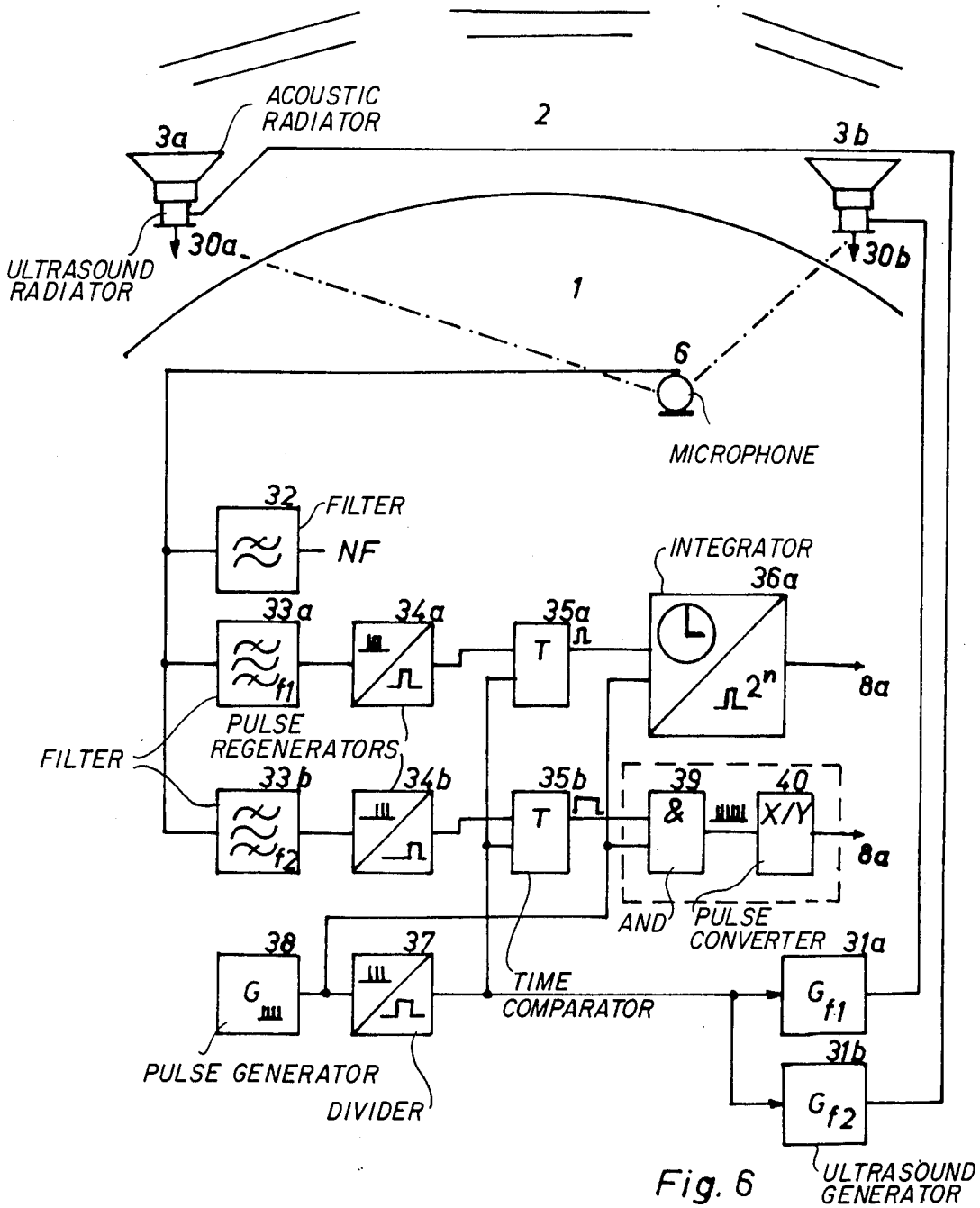

FIG. 6: an automatic input configuration.

FIG. 1 serves for the clearer explanation of the principle of the invention and the suggested further developments with an abstractly considered microphone 6 for the mobile solo source of a large-area acoustic radiation system.

The acoustic radiators 3*a* to 3*n* represent some of the distributively provided acoustic radiators in the action area 1 and the reception area 2 (see FIG. 2), whereby the location of the acoustic radiators 3*n* is considered variable. To the acoustic radiators 3*a*, 3*b* . . . 3*n* is assigned a device for non-reactive, differentiated summation and distribution 4, which thereafter will be referred to in shorter form as acoustic radiator summation distributor, which is represented as a block, and which has its additional inputs connections for additional source branches, which are not illustrated. Between the microphone 6 and the acoustic radiator summation distributor 4 are illustrated a controllable amplification device 5, a source-assigned device for differentiated, non-reactive presummation and distribution 10, which thereafter will be referred to in shorter form as source summation distributor, and a controllable delay device 9. The illustrated source summation distributor 10 with its suggested additional inputs serves again as a link to other source branches, which are not illustrated, with reference to classification or evaluation according to source categories, which is further elaborated in FIG. 3.

The controllable amplification device 5 and the controllable delay device 9 are provided with control inputs 7, connected to an adjustment or control device 8, which represents a main characteristic of the invention, and which, as suggested in the block, essentially consists of an input configuration of the sources or microphone positions 8*a*, an input configuration for the acoustic radiator positions 8*c*, and a comparison and control device 8*b*. Further connections for the adjustment or control device 8 to the summation distibutors 4 and 10 are indicated, which will be discussed below.

The input configuration 8*a* of the microphone or source positions can be realized, for example, by a simulation of the action surface or a distance measuring device. In the input configuration of the acoustic radiator positions 8*c* are stored fixed position indications for fixed locations. Variable values for location-variable acoustic radiators can be stored in the same way as for mobile solo microphones. The comparison and control device 8*b* compares the positions and derives the place value for the acoustic propagation times and level values which result from the differences of the positions and applies them to the controllable delay and amplification devices 9 and 5.

The comparison and control device 8 sets for each of the outputs of the remotely controllable delay devices 9, corresponding to the number n of the acoustic radiators, a delay time corresponding in value approximately to the propagation time, as well as staggers the amplifications or dampenings for the correct level classification of the controllable amplification device 5.

The block diagram of FIG. 2 shows a randomly selected action area 1 with several variations and further developments contained in subordinated features of the invention, concerning the acoustic radiator configuration and source applications, which are also possible in different combinations. Two solo sources having the microphones 6*a* and 6*b* can be moved in random form over the action area 1. A low-capacity source of reduced spatial expansion can be conveyed on the platform in various positions together with the microphone 6*c*, the acoustic radiator 3*n*, and the accompanying acoustic radiator 3*i*. A spatially extended source of high sound capacity is provided with several microphones 6*d* to 6*m*. Of the acoustic radiators are represented 3 main groups of loudspeakers 3*a*; 3*b*; 3*c* in the boundary area between the action area 1 and the reception area 2.

In the lateral and rear sections of the action area 1 are positioned the acoustic radiators 3*d* to 3*g* which are provided for supporting sources of low sound capacity, as well as for supplying the action area 1. The acoustic radiator 3*h* supplies the spatially extended source of great sound capacity.

FIG. 3 shows a block circuit diagram for the block diagram of FIG. 2, which has corresponding microphone and acoustic radiator designations. Whereas the fixedly installed acoustic radiators 3*a* to 3*c* are connected to the fixedly set delay device 9*d* and to the source summation distributor 10*b*; 10*d*, the variably configured acoustic radiators 3*d* to 3*n* are connected to controllable delay devices 9*a*; 9*b*; 9*c* and source summation distributors 10*a*; 10*c*, whereby for mobile microphones the delay devices 9*a* and 9*b* of the fixedly installed acoustic radiators are also variably controllable.

The microphones 6*d* to 6*m* are conventionally connected to the amplification devices 5*d* to 5*m* of which the outputs are summarized via a source distributor 10*d* in a source summation device 10*b*. The output of this source summation device 10*b* is connected to a delay device 9*d* according to the known principles of the comparison system. The variously delayed outputs of the delay device 9*d* are connected to the acoustic radiator summation distributor 4, consisting of a distributor 4*a* and non-reactive summation device 4*b*.

The microphone 6*c* is also connected to an amplification device 5*c* of which the output is connected via a source distributor 10*c*, not only to the source summation devices 10*a* and 10*b*, and via the delay devices 9*c* and 9*d* to the acoustic radiator summation distributor 4, which furthermore leads to the acoustic radiators 3*a* to 3*g*, but also via the acoustic radiator distributor 4*a* directly to the acoustic radiator 3*n*. The outputs of the amplification devices 5*d* to 5*m* can also be connected via the source distributor 20*d* and the summation device 10*a* to the input of the delay device 9c, so that the acoustic radiators 3d to 3g are connected via the acoustic radiator summation distributor 4 to outputs of the delay device 9c.

This distribution system is especially advantageous for the amplification of stationary individual and/or group signal sources of low sound capacity.

By changing the location, not only of the microphone 6c, but also of the acoustic radiator 3n, the microphone 6c is connected to the source distributor 10c and to the summation device 10a, and via the delay devices 9b and 9c to the acoustic radiator summation distributor 4, which is connected to the acoustic radiators 3a to 3h, whereby the acoustic radiator 3n is connected directly to the distributor 10c.

The microphone 6b is connected via the amplification device 5b, which consists of several inputside parallel-switched, controllable amplifiers, to the distributor 10c for minimizing the required amplification channels, of which the outputs are applied to the inputs of the summation devices 10a and 10b, as well via the delay devices 9b; 9c to the distributor 4a and the summation device 4b, so that not only the acoustic radiators 3a to 3c, but also 3d to 3n are connected to the outputs of this summation device in a non-reactive and differentiated way.

The microphone 6a is connected via the amplification device 5a and the distributor 10c to the input of the controllable delay device 9a of which the outputs are also applied to the inputs of the acoustic radiator summation distributor 4, which sums all assigned input lines, and assigns them to the acoustic radiators 3a to 3n.

The control inputs 7 of the controllable devices for amplification 5b, distribution 10c, delay 9a; 9b, and in a given case, 9c, as well as the summation distributor 4 are connected to the corresponding outputs of the adjustment and control device 8.

The control input for the acoustic radiator summation distributor 4 controls the differentiated amplification of the acoustic radiators 3a to 3n and the variable distribution of the input signals of the distributor 4a.

In the frequently used case of a partial or complete acoustic radiation according to the so-called play-back method, whereby the original sound sources are partially or entirely simulated by sound recordings, the corresponding microphones are replaced by the outputs of sound memory devices, whereby it is advantageous that the main acoustic radiators in the action area are individually complemented by one or several acoustic radiators 3d; 3e simulating the original sound, which are positioned in the vicinity of the corresponding source location.

A similar procedure applies also to the amplification of low-capacity original sound sources; FIG. 2 shows an example of such an acoustic radiator 3n, which supports the original sound, whereby the input signal thereof is taken off without delay by the output of the amplification device 5c.

In order to avoid feedback, appropriate microphones and acoustic radiators are provided with suitable directional characteristics.

For the supplementary acoustic radiators 3h; 3l, which are utilized, for example, for actors, after the amplification devices 5 there are inserted additional distributors 4a and summation device 4b to which these acoustic radiators are connected.

An advangageous embodiment of controllable amplification devices 5 of FIGS. 1 and 3 and of their input configuration of the source or microphone position 8a of the adjustment or control decive 8 for the level and direction modulation of mobile (solo) sources is illustrated in FIG. 4.

The microphone 6 assigned to a mobile solo source, or a replacement sound signal source (for instance, a play-back magnetic recording device) which simulates this source, is connected to at least two controllable amplification devices 5a; 5b; 5c, which can be configured, for instance, as voltage-controlled amplifiers (VCA). The outputs of the controllable amplification devices 5 are connected to the inputs of the source summation distributor 10, of which the output signals are connected, for instance, to the delay devices 9 represented in FIGS. 1 and 3. An operating module for level modulation 16 is connected via multipliers 17a; 17b; 17c to the control inputs of all existing controllable amplification devices 5a; 5b; 5c.

Outputs of the input configuration of the source or microphone positions 8b, or in another configuration of the comparison and control device 8b, which are components of the adjustment or the control device 8 (see FIGS. 2 and 3), are also connected to the corresponding inputs of the multipliers 17a; 17b; 17c. By actuating the operating module for level modulation 16, all existing controllable amplification devices 5; 5a; 5b; 5c are therefore changed in the same direction in their amplification, whereas by actuating the input configuration of the source or microphone positions 8a, a differentiated regulation of the amplification of the same amplification devices 5; 5a; 5b; 5c occurs in order to set the required level difference for the directional effect between the output signals of the amplification configuration. The control signals of both input and operating modules 8a and 16, which can be available not only in the form of a direct-current signals for the control of the VCA's, but also in digital form, are linked in the multipliers 17a; 17b; 17c channelwise in resulting control signals which are applied to the control inputs of the amplification devices 5a; 5b; 5c. Thus can be realized in each channel not only the required amplification changes for influencing the level or the modulation of the source signal, but also for influencing the directional modulation by means of the same controllable amplification devices 5a; 5b; 5c. This makes it possible to reduce the expenses for the respective sound channels, and to improve the transmission quality. Such controllable amplification circuits are also advantageous in sound mixing consoles of multichannel recording technology, such as two-channel stereophony or quadrophony.

The input configurations 8a and 8c can be realized in various ways within the adjustment and control device 8. One possible configuration consists of a group of switches, for instance, in form of keyboard switches, sensors or other contact components, which can be configured, for example, in the form of a matrix, which simulates the geometrical ratios of the action area of the auditorium to be acoustically radiated, so that certain partial areas of the action area are individually assigned to a switch provided with an indication element (for instance, a lamp, or LED). Another configuration of the operation and indication elements is possible, whereby, for instance, the periphery of the action area is marked by switches, whereas the inner surface of the action area simulated in this way, is provided with suitable indication elements which indicate the individual (imaginary) positions of the mobile sound source.

A further variation of the operating field consists in a transmitter of coordinates having operating elements which can be freely moved in all directions of a plane, and which transmits its positional coordinates, for instance, in the form of counter pulses, code words or direct-current signals. A graphic display, for instance, a video monitor, is also possible which performs this function with a manual follow-up element, such as, for instance, a light pen or another optoelectronic sensor.

For the first-mentioned configuration a circuit configuration of the input configuration 8*a* of the adjustment or control device 8 is suitable, of which a portion of a line or column is illustrated in FIG. 5.

The primary connections of the switches 20*a*; 20*b*; 20*c*, which are represented as manual keyboard switches, are connected to a common potential, whereby each of the secondary connections are connected to an input of a logic OR-circuit 21, so that on the output thereof, by means of operating any of the switches there results a L-signal which, via an AND-element 22 utilized as gate circuit, turns on a timing signal produced by a frequency variable clock generator 23 on the individual timing inputs of the up/down counters 24*a*; 24*b*; 24*c* assigned to each switch. The control inputs for the forward or reverse operation of these counters are individually connected to one of the secondary connections of the switches 20*a*; 20*b*; 20*c* such that the F/R-counter 24*b* assigned to each of the operated switches 20*b*, for instance, counts forward, whereas all the remaining counters count in the opposite direction. The data outputs of the counters 24, emitting the counter position, for instance, in binary coded form, each are connected to the input of the coder 25*a*; 25*b*; 25*c* decoding the input data word produced by passing through the counting stages and forming it in a correspondingly formed output data word. These output data words of the coder 25 suitably control the parameters of the controllable delay devices 9, the amplification devices 5, or the summation distributors 4 and 10, which are connected to the first outputs of the coder. Suitable indication elements 27*a*; 27*b*; 27*c* in the operating field, such as, for instance, lamps, LED's, or LCD-displays, can be connected to the second outputs. By utilization of direct-voltage controlled amplifiers 5 (so-called VCA's), digital-analog converters 26*a*; 26*b*; 26*c* are switched in for this purpose.

The coders 25 and the digital-analog converters 26 can also be reduced to individual function blocks of random kind when the monitoring of the counter outputs, as well as the output of the control values to the delay, amplification and distribution devices which have to be controlled, is realized by means of a timing multiplexer system, which is not illustrated.

The functions of the above described circuit can also be realized advantageously by higher integrated components, such as, for instance, a microprocessor.

The configuration illustrated in FIG. 6 shows an easily comprehensible example of an automatic source locating device for approximately sound-path proportional control, whereby the comparison of the acoustic radiator locations to the source location is already performed without further auxiliary devices directly by means of a distance measuring device.

In the same location, together with the acoustic radiators 3*a* and 3*b* are provided ultrasound radiators as acoustic measuring signal generators 30*a* and 30*b*, whereby each is connected to a scanned ultrasound generator 31*a* and 31*b*. The microphone 6 is located in the action area 1 at various distances from the two acoustic radiators 3*a* and 3*b*, and is provided for recording the utilized ultrasound frequencies. It can also be configured, for instance, as a wireless stage microphone, and transpose the recorded scanned ultrasound signals also into other frequency ranges. In FIG. 6, however, the simplest case of a wire connection is presented, which is realized by branching via three filters 32; 33*a* and 33*b*.

The first filter 32 is a low-pass filter, and the sound signal of the source is applied at its output. The other two filters 33*a* and 33*b* are frequency-selective filters, such as, for instance, PLL-filters, which are adjusted to the two ultrasound frequencies $f_1$; $f_2$.

The scanning signals recovered in the scanning pulse, regeneration circuits 34*a*, 34*b*, which can comprise, for instance, amplifers, rectifiers and threshold value controls, are of equal duration, but are transposed by the sound propagation time of subsequent flanks with respect to the original scanning signals, which are applied to the scanning inputs of the ultrasound generators 31*a* and 31*b* and to the other inputs of the time comparison circuits 35*a* and 35*b*, for which, for instance, RS-triggers can be utilized, whereby the original scanning signals are applied to the setting input, and the recovered delayed scanning signals are applied to the reset input. Only the first frontal flank of the reset pulse controls, so that eventual, additionally reflected ultrasound pulses coming in later remain ineffective. The outputs of the time comparison circuits 35*a* and 35*b*, to which pulses of propagation time proportional duration are applied, are connected to the time value converters 36*a* and 36*b* which, in the simplest case, are integration elements, which convert these pulses into suitable adjustment or control magnitudes for the controllable delay or amplification devices.

One of the possible embodiments of a time value converter geared to the particular conditions of the invention is illustrated in the lower time value converter 36*b* of FIG. 6. Because it is necessary to take into consideration interferences of the scanning pulse transmission via the ultrasound stretch, such as, for example, temporary shadowing with the loss of individual transmitted scanning pulses, it is recommended to insert a logic comparison circuit, which controls it, and which can be most easily realized by means of counters.

Thus the scanning pulse production is performed by means of a divider 37, which is inserted after the timing pulse generator 38. The timing pulses are furthermore applied to an input of an AND-gate 39 in the time value converter 36*b*, and on its other input there are applied the pulses of propagation time proportional duration.

Accordingly, on the ouput of the AND-gate 39, there is available each time a number of timing pulses proportional to the propagation time, which can be analyzed with a counter which, for instance, is started by the frontal flanks of the scanning pulse and is compared to the previous number of the scanning pulses, whereby the transmission at first takes place at the rear flank of the transmitted scanning pulse, and is transmitting the limited difference of both counter readings, the adjustment magnitude and the adjustment direction to the control input of the controllable delay or amplification devices.

A missing scanning pulse does not lead to transmission and to adjusting, but to a renewed counting; this also applies when an adjustable difference limitation is exceeded, for instance, when instead of a shadowed direct scanning pulse a deflected one has been transmitted.

This is but one of the many possible self-controlling conversion circuits 40 of a number of timing pulses in the adjustment magnitude, and it therefore is only summarily represented.

Without requiring a further figure, in FIG. 6 can also be recognized a possible expansion for a multitude of acoustic radiator locations and microphones. With two, or by height staggering, three ultrasound radiators 30 at the limits of the action area, the coordinates for a random number of source locations can be determined and stored by multiplying the circuit portions 33 to 36. These coordinate values are at disposal, either parallel or serially, as input configuration 8*a* of the source or microphone positions. Similarily, the input configuration of the acoustic radiator positions 8*c* can also represent a memory. Consequently, the comparison and control device 8*b* favorably consists of a computer, which cyclically calculates the relationships of the coordinates, compares the actual results with the values of the previous cycle, and if necessary, after further comparison and control calculation, emits the adjustment magnitudes and directions as addressed commands to the various controllable delay or amlplification devices.

The automatic input can also advantageously be combined with a manual input, which reduces the technical requirements for the microphones assigned to the stationary sources, as well as the operating requirements for soloists with many location changes

We claim:

1. In a large-area sound reinforcement system for multi-dimensional extended action and reception areas having several distributed sound radiators and microphones as well as devices for the delay, amplification and non-reactive summation in the microphone sound radiator connections, at least one of the microphones being assigned to a solo source; the improvement wherein at least two of the devices for the delay and for amplification disposed in connections assigned to said one microphone comprise a device for the control of delay times and at least another for the control of amplitudes, wherein, in addition to sound radiators positioned in the transitional area between the action area and the reception area, additional sound radiators distributed in the action area are connected to the output devices for the summation and distribution of said connections, and wherein a control device for said two devices for delay and amplification is comprised of input means for receiving microphone position and sound source power data and for receiving sound radiator position and power data, and a comparison and control device for deriving delay time and amplitude signals for the control of said two of said devices for delay and amplification from the comparison of said position and sound power data.

2. The large-area sound system of claim 1 wherein the input means for the sound radiator powers, for the coordinates of fixedly installed sound radiators and for the sound source powers comprise constant storage devices, and adjustable input panels are used for the coordinates of location-variable solo sources and location-variable sound radiators.

3. The large-area sound system of claim 1 wherein the input means for the sound radiator powers, for the coordinates of fixedly installed sound radiators and for the sound source powers comprise constant storage devices, and adjustable locating devices are used for the coordinates of location-variable solo sources and location-variable sound radiators.

4. The large-area sound system of claim 1 wherein the input means have numerical or digital output values of the sound powers or coordinates, and the comparison and control devices comprise a computer for providing control values for the control of said devices for delay and amplification.

5. The large-area sound system of claim 1 wherein the output devices for the summation and distribution are coupled to a plurality of microphones assigned to a source areea and the signal portions are included in the comparison of sound power.

6. The large-area sound system of claim 1 wherein the control of more than one device for the amplification or summation with regard to the amplitudes comprises multiplying control circuits, the inputs of which are connected to outputs of the control device and of the operating devices for level alignment, and the outputs of which are connected to the control inputs of at least two controllable amplifiers having signal inputs connected to a source.

7. The large-area sound system of claim 1 wherein controllable attenuators are inserted between the output devices for summation and distribution and additional sound radiators in the action area, the control inputs of the attenuators being connected to the output of the comparison and control device extended by a location coincidence test device.

8. The large-area sound system of claim 1 wherein the input means for the microphone locations and sound source powers and comparison and control units have an additional connection to units for the generation of reflections, whereby an adaptation of the degree of simulation of the acoustic sound field to the sound source location and the sound source power can be made.

9. The large-area sound system of claim 2 wherein the adjustable input panels are simulations of action areas having an operating field which represents therein the sound source and sound radiator locations, and the associated comparison device is a combination of these input panels for the proportional shifting of delay time and amplitude steps.

10. The large-area sound system of claim 2 wherein the adjustable inputs panels each consist of one row of switches assignaed to coordinates, on the one hand connected to a common potential and on the other hand to the inputs of an OR circuit and the up-down control inputs of an up-down counter, the clock inputs of the counter being connected to the output of an AND circuit, the inputs of the AND circuit being connected to the output of the OR circuit and a keying signal of variable frequency, and the data output of the up-down counter being connected by way of a coder to the comparison and control device.

11. The large-area sound system of claim 3 wherein sound measuring signal generators or sound measuring signal receivers are provided for the locating devices and are assigned on the one hand to the location-variable solo locations and at least to two locations at the edges of the actions area on the other hand are coupled with each other and by way of coders to the comnparison and control devices.

12. The large-area sound system of claim 10 wherein sound measuring signal generators are connected to pulsed ultrasound signals generators, microphones are connected to ultrasound receivers, wherein at the end of the electrical or optical transmission path of the microphone, separation devices are provided, and the clock sigtnals for the ultrasound signal generators and the transmitted recovered Pulses are applied to time comparison circuits to emit pulses of approximately propagation path proportional duration of which the outputs are coupled to the control inputs of the controllable delay or amplification devices, when the test signal generator and sound radiator are disposed at the same location.

* * * * *